US006743762B1

(12) United States Patent
Carr et al.

(10) Patent No.: US 6,743,762 B1
(45) Date of Patent: Jun. 1, 2004

(54) CARBONATE BASED LIQUID LAUNDRY DETERGENT BOOSTER

(75) Inventors: Charles D. Carr, Yardley, PA (US); Archana Gupta, Pronceton, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 0 days.

(21) Appl. No.: 10/305,852

(22) Filed: Nov. 27, 2002

(51) Int. Cl.[7] ..... C11D 17/00

(52) U.S. Cl. ..... 510/276; 510/337; 510/394; 510/405; 510/436; 510/473; 510/505; 510/509; 510/524

(58) Field of Search ..... 510/276, 337, 510/405, 436, 394, 473, 505, 509, 510, 524

(56) References Cited

U.S. PATENT DOCUMENTS 4,414,128 A * 11/1983 Goffinet ..... 252/111
6,022,843 A 2/2000 Shanks et al.
6,228,821 B1 5/2001 Sliva

* cited by examiner

*Primary Examiner*—Necholus Ogden
(74) *Attorney, Agent, or Firm*—Stephen B. Shear

(57) ABSTRACT

The present invention is a laundry detergent booster liquid composition comprising from about 0.3% to about 7% of a soluble alkali metal carbonate, especially sodium carbonate in an aqueous solution. The booster liquid formulation may contain additional laundry detergent additive materials such as thickening agents, optical brighteners, anti-redeposition agents, surfactants, phosphates, dyes, and fragrances in addition to the alkali metal carbonate.

7 Claims, No Drawings

CARBONATE BASED LIQUID LAUNDRY DETERGENT BOOSTER

CROSS-REFERENCE TO RELATED APPLICATIONS

Not Applicable

STATEMENT REGARDING FEDERALLY SPONSORED RESEARCH OR DEVELOPMENT

Not Applicable

FIELD OF THE INVENTION

This invention relates to liquid formulations which are laundry detergent booster systems. The invention particularly relates to carbonate based, especially sodium carbonate based liquid boosters for laundry detergents.

BACKGROUND OF THE INVENTION

Commercial laundry detergents, whether solid or liquid have limitations as to the amount of builders that can be effectively utilized. Liquid detergents are particularly plagued by limits in solubility of the various components as well as ingredient incompatibility. Balances must often be reached between the detergent material and the builder on a variety of parameters. As such, booster systems for commercial laundry detergents have come into favor from time to time. VIVID and CLOROX 2 are laundry detergent booster liquids that are hydrogen peroxide based, while BLEACH-FREE CLOROX 2 is a laundry detergent booster liquid that is enzyme based. Both of these types of systems have their own inherent weaknesses and disadvantages. For example, enzyme based systems are expensive and for any enzyme material which has not been irreversibly denatured in the course of the wash cycle, active enzyme is discharged into the environment. Hydrogen peroxide based boosters require low pH to remain shelf stable (~pH 3). Domestic detergents are generally formulated at pH's above 8, the point being that the higher pH levels provide better overall cleaning.

OBJECTS OF THE INVENTION

It is therefore an object of the invention to provide a booster system for a laundry detergent which is free of the foregoing defects of known laundry booster systems and actually raises the pH of liquid laundry wash liquor to a point where cleaning is more effective.

It is another object of the invention to provide a carbonate based laundry booster.

It is still another object of the invention to provide a method of improving the cleaning obtained from commercial liquid laundry detergent products by utilizing a laundry detergent booster product.

Still other objects of the invention will be recognized by those of ordinary skill in the art.

BRIEF SUMMARY OF THE INVENTION

The foregoing objects are surprisingly achieved by a laundry detergent booster liquid composition comprising a soluble alkali metal carbonate, especially sodium carbonate in an aqueous solution in an amount sufficient so that for the given unit of use in a standard 70 liter wash bath, the booster contribution of alkali metal carbonate in the wash is from about 0.0003% to about 0.008% of the wash liquor volume.

For a typical convenient consumer unit of use of about 80 g, this corresponds to a soluble alkali metal carbonate concentration in the booster of about 0.3 to about 7%. The booster liquid formulation may contain additional laundry detergent additive materials such as thickening agents, optical brighteners, anti-redepositions agents, surfactants, phosphates, dyes, and fragrances in addition to the alkali metal carbonate.

BRIEF DESCRIPTION OF THE DRAWING

Not Applicable

DETAILED DESCRIPTION OF THE INVENTION

The invention is a laundry detergent booster liquid formulation comprising a soluble alkali metal carbonate, especially sodium carbonate in an aqueous solution in an amount sufficient so that for the given unit of use in a standard 70 liter wash bath, the booster contribution of alkali metal carbonate in the wash liquor is from about 0.0003% to about 0.008% of the wash liquor volume, preferably about 0.0011% to about 0.008%, more preferably about 0.0019% to about 0.0066%, still more preferably about 0.0038% to about 0.0060%, most preferably about 0.0055% These levels correspond to a product having a convenient unit of use volume of about 80 g of from about 0.3% to about 7%, preferably from about 1% to about 7%, more preferably about 1.75% to about 6%, still more preferably about 3.5% to about 5.5%, most preferably about 5% of an alkali metal carbonate, preferably sodium carbonate or potassium carbonate, more preferably sodium carbonate, based on the entire booster product formulation volume. In other words, the amount of alkali metal carbonate added to the wash liquor (of about 70 liters) is from about 0.21 grams to about 5.6 grams, preferably from about 0.78 grams to about 5.6 grams, more preferably from about 1.33 grams to about 4.62 grams, still more preferably from about 2.66 grams to about 4.2 grams, most preferably about 3.85 grams.

In addition to the alkali metal carbonate and water, the composition of the invention may include, but need not include, other laundry detergent compatible components such as thickeners, optical brighteners, anti-redeposition agents, anionic or nonionic surfactants, glycols, phosphates, citrates, dyes, and/or fragrances. For the balance of this description, reference to % with respect to ingredients other than the alkali metal carbonate and water in the booster refer to concentrations for a booster product having a convenient unit of use size of about 80 g however, the products that may be more concentrated with respect to the alkali metal carbonate than those for a unit of use of about 80 g will also be correspondingly more concentrated for the other components that may be present. Similarly, the products that may be less concentrated with respect to the alkali metal carbonate than those for a unit of use of about 80 g will also be correspondingly less concentrated for the other components which may be present. In other words, if one views the about 80 g unit of use product limitations, the mere addition or removeal of water therefrom does not remove the product from the scope of the present invention, but merely changes the size of the unit of use to compensate for the difference in concentration of alkali metal carbonate in the booster product in question.

Generally when present, the dye is present in an amount of up to about 0.015%, preferably up to about 0.01%, more preferably up to about 0.05% of the invention composition, and fragrance, when present, is present in an amount of up to about 0.15%, preferably up to about 0.1%, more preferably up to about 0.05% of the invention composition. Any laundry detergent suitable dye and fragrance is suitable for use in the present invention and those of ordinary skill will be well aware of how to pick suitable candidates.

When a phosphate is present, it can be an alkali metal phosphate, orthophosphate, metaphosphate, or polyphosphate, with the sodium or potassium slats thereof being preferred, sodium being the most preferred alkali metal. Of the phosphates, tripolyphosphate is a preferred species, with sodium tripolyphosphate being most preferred. When a phosphate is present, the phosphate is used in an amount of up to about 0.65%, preferably about 0.4% to about 0.6%, more preferably about 0.45% to about 0.55%, most preferably about 0.5%. The surfactants which may be utilized include anionic and nonionic surfaciants, with the anionic surfactants being preferred. Suitable anionic surfactants include linear alcohol sulfate (LAS), linear alcohol ethoxylate sulfate (AES), and aryl sulfonate (AS) and the corresponding disulfonates, preferably AES & disulfonates, most preferably disulfonate. Suitable nonionic surfactants include alcohol ethoxylate (AE), nonylphenylethoxylate (NPE), alkyl poly glucoside (sugar surfactant sold by Cognis/Henkel) (APG), preferably AE & NPE, most preferably AE. While there is generally no limitation on the number of ethoxylation units or on the linear alcohol size in the surfactants, 1–7 moles of ethoxylation are preferred and 1–3 moles of ethoxylation are more preferred for the anioinic surfactants and 6–12 moles of ethoxylation are preferred, with 7–9 moles of ethoxylation being more preferred for the nonionic surfactants. In all cases where a linear alcohol is present, the alcohol may be of any size, but linear alcohol groups of 12 to 16 carbons are preferred. The specified surfactants may be substantially pure molecules or blends of molecules within given ranges of ethoxy units and linear alcohol groups. When the formulation includes a surfactant, the surfactant is present in an amount of up to about 0.35%, preferably from about 0.15% to about 0.30%, more preferably from about 0.21% to about 0.25%, most preferably about 0.23%.

Anti-redepostion polymers generally known in the art are suitable for use in the present invention. These include, but are not limited to polyacrylate such as Acusol 445 (Rohm & Haas). Other anti-redeposition agents such as citrates and silicates are also suitably used. When present, the anti-redeposition agent (polymer or otherwise) is used in amounts of up to 0.3%, preferably about 0.15% to about 0.25%, more preferably about 0.15% to about 0.23%, most preferably about 0.19% of the invention composition.

Optical brighteners are also suitably used in the present invention. These are preferably stilbene compounds typically known in the laundry detergent art. Preferred optical brighteners include dibenzofuran biphenyl derivatives, preferably stilbene, most preferably diaminostilbenedisulfonic acid, and are generally used in amounts of up to about 0.15%, preferably from about 0.09% to about 0.11%, most preferably 0.10% of the invention formulation.

Glycols are another optional component of the instant formulation. Preferably the glycol is selected from the group consisting of propylene glycol, or glycerol, most preferably propylene glycol. When present in the invention formulation, the glycol is used in amounts of up to about 4%, preferably from about 2% to about 3.5%, more preferably from about 2.5% to about 3.4%, still more preferably about 2.7% to about 3.3% and most preferably about 3% of the invention formulation.

Frequently an optional thickening agent is used to increase the viscosity of the formulation. The thickener can be any viscosity enhancer known to be compatible with laundry detergents. Suitable thickeners include, but are not limited to guar gums, xanthan gums, and high MW (about 500,000 to about 1,000,000 molecular weight) polymers (such as R&H Acusol 820 & 823), preferably xanthan gum. When present, the thickeners are utilized in amounts of up to about 0.45, preferably from about 0.15% to about 0.25%, most preferably about 0.2% of the invention formulation.

The liquid formulation of the present invention is added directly to the wash liquor, or may be diluted with water before adding it to the wash water) to improve the performance of commercial laundry detergent products, by delivery of alkali carbonate builder.

The following examples merely demonstrate, but do not limit, the present invention.

EXAMPLES

Example 1

Laundry Detergent Liquid Booster

A laundry detergent liquid booster of the invention is prepared according to the following formulation:

| Component | weight % |
|---|---|
| Distilled Water | 90.72 |
| Xanthan Gum | 0.20 |
| diaminostilbenedisulfonic acid | 0.10 |
| Acusol 445 | 0.19 |
| Dowfax 2A1 (Disulfonate Surfactant) | 0.23 |
| Propylene Glycol | 3.00 |
| Sodium Tripolyphosphate | 0.50 |
| Sodium Carbonate | 5.00 |
| Dye | 0.005 |
| Fragrance | 0.05 |
| | 99.995 |

The components are added in any desired order and is within the discretion of the particular formulator.

Example 2

Carbonate Content Limitations

Formulations as set forth below were prepared. Each is the same except for the amount of sodium carbonate delivered. The formulations were used (total of 80 grams of each formulaton) in conjunction with a 98 g amount of commercially available Tide Liquid. Each 80 grams of booster formulation contained 0.15 g of Acusol 445, 0.8 grams of sodium tripolyphosphate, 0.05 grams of brightener, in addition to sodium carbonate. The sodium carbonate content of the booster formulations was varied between 1.75% and 28% (1.75%, 3.5%, 7.0%, 14%, and 28%). Standard fabric stained in consistent manners were washed therein in approximately 70 liters of wash liquor and the results are set forth in the table below.

| Stain | Fabric | control | Control + 1.75% booster | Control + 3.5% booster | Control + 7.0% booster | Control + 14% booster | Control + 28% booster |
|---|---|---|---|---|---|---|---|
| Grass | Cotton | 70.8 | 76.7 | 74.3 | 70.7 | 65.8 | 56.4 |
| Red Wine | Cotton | 71.2 | 73.4 | 71.7 | 69.9 | 66.6 | 58.9 |
| EMPA 116* | Cotton | 45.6 | 53.0 | 56.0 | 56.7 | 58.7 | 52.2 |
| EMPA 117** | Polycotton | 68.1 | 71.6 | 73.7 | 74.9 | 75.9 | 65.9 |
| Egg Yolk | Cotton | 78.8 | 81.8 | 82.2 | 86.3 | 90.6 | 91.2 |
| Mustard | Cotton | 27.1 | 28.7 | 29.0 | 30.1 | 37.5 | 45.5 |
| Blueberry | Cotton | 59.1 | 66.4 | 70.3 | 78.5 | 84.1 | 87.2 |
| Blood | Cotton | 70.8 | 74.5 | 75.4 | 75.6 | 76.8 | 77.0 |
| Coffee | Cotton | 63.8 | 64.6 | 64.5 | 60.6 | 57.4 | 55.0 |
| Choc. Ice Cream | Cotton | 87.2 | 87.5 | 86.8 | 84.2 | 83.7 | 84.5 |

*EMPA 116 = blood, milk and carbon black on cotton
**EMPA 117 = blood, milk and carbon black on polycotton The data reveals that the boosters of the invention when used at the claimed concentrations delivers improved cleaning with respect to virtually all of the stains tested. However, at concentrations above those of the invention, cleaning of various stains is less than that of the control detergent (without booster) for a significant number of stains.

We claim:

1. A method of boosting the cleaning performance of a laundry detergent in a wash liquor comprising adding to the wash liquor a composition comprising water and sodium carbonate in an amount such that about 0.21 grams to about 5.6 grams of said sodium carbonate is added per approximately 70 liters of wash liquor, and wherein said composition further comprises sodium tripolyphosthate, a polyacrylate anti-redeposition agent, and a stilbene brightener.

2. The method of claim 1 wherein said composition further comprises at least one component selected from the group consisting of thickeners, surfactants, lower-alkylene glycols, citrates, dyes, and fragrances.

3. The method of claim 1 wherein said composition has an approximate unit of use volume of about 80 g per approximately 70 liters of wash liquor.

4. The method of claim 3 wherein said composition comprises about 0.3% to about 7% sodium carbonate.

5. The method of claim 2 wherein said composition comprises water, sodium carbonate, xanthan gum, a stilbene optical brightener, a polyacrylate anti-redeposition agent, a disulfonate surfactant, propylene glycol, a phosphate, optionally a dye, and optionally a fragrance.

6. The method of claim 5 wherein said composition comprises

| | |
|---|---|
| Distilled Water | |
| Xanthan Gum | up to about 0.45 parts |
| diaminostilbenedisulfonic acid | up to about 0.15 parts |
| Acusol 445 | up to about 0.3 parts |
| Disulfonate Surfactant | up to about 0.35 parts |
| Propylene Glycol | up to about 4.00 parts |
| Sodium Tripolyphosphate | up to about 0.65 parts |
| Sodium Carbonate | about 1 to about 7 parts |
| Dye | up to about 0.015 parts |
| Fragrance | up to about 0.15 parts |

7. The method of claim 5 wherein said composition comprises

| | |
|---|---|
| Distilled Water | q.s. 100.00% |
| Xanthan Gum | about 0.20 |
| diaminostilbenedisulfonic acid | about 0.10 |
| Acusol 445 | about 0.19 |
| Dowfax 2A1 (Disulfonate Surfactant) | about 0.23 |
| Propylene Glycol | about 3.00 |
| Sodium Tripolyphosphate | about 0.50 |
| Sodium Carbonate | about 5.00 |
| Dye | about 0.005 |
| Fragrance | about 0.05. |

* * * * *